United States Patent [19]

Eskelinen et al.

[11] Patent Number: 4,539,762

[45] Date of Patent: Sep. 10, 1985

[54] POCKET VENTILATING APPARATUS FOR A MULTI-CYLINDER DRYER OF A PAPER MACHINE

[75] Inventors: Pekka Eskelinen; Vesa Vuorinen, both of Turku, Finland

[73] Assignee: Valmet OY, Finland

[21] Appl. No.: 584,341

[22] Filed: Feb. 28, 1984

[30] Foreign Application Priority Data

Mar. 1, 1983 [FI] Finland ..... 83 0675

[51] Int. Cl.[3] ..... F26B 13/08

[52] U.S. Cl. ..... 34/114; 34/116; 34/122

[58] Field of Search ..... 34/111, 114, 116, 122, 34/123

[56] References Cited

U.S. PATENT DOCUMENTS

| | | | |
|---|---|---|---|
| 3,110,575 | 11/1963 | Justus | 34/114 |
| 3,337,968 | 8/1967 | Krikorian et al. | 34/111 |
| 3,384,973 | 5/1968 | Johansson | 34/111 |
| 3,388,479 | 6/1968 | Gardner | 34/114 |
| 3,427,727 | 2/1969 | Villalobos | 34/1 SS |
| 3,668,787 | 6/1972 | Berg et al. | 34/111 |
| 4,268,974 | 5/1981 | Price | 34/114 |
| 4,416,070 | 11/1983 | Vedenpaa et al. | 34/114 |
| 4,441,263 | 4/1984 | Vedenpaa | 34/116 |

*Primary Examiner*—Larry I. Schwartz
*Assistant Examiner*—David W. Westphal
*Attorney, Agent, or Firm*—Steinberg & Raskin

[57] ABSTRACT

Apparatus for ventilating pockets in a multi-cylinder dryer of a paper machine of the type in which guide rolls are situated in spaces between adjoining drying cylinders and wherein a wire or felt has free runs between the drying cylinders and the guide rolls. With respect to a particular pocket to be ventilated, the apparatus functions to blow air through the inlet or incoming free run of the wire into the pocket with air being removed from the pocket at least partially through the following or outgoing free wire run following the guide roll. The apparatus comprises nozzle apparatus including a nozzle nose situated proximate to the incoming free wire run, at least two nozzles being defined by the nozzle nose which extend transversely to the direction of run of the wire. Air is blown through the nozzles into a space defined by the incoming free wire run facing the nozzles, by the guide roll and by the nozzle nose. In this manner, a positive pressure is generated in an area of the wire over a length of the incoming free wire run by the effect of which air flows within the area through the wire into the pocket. The nozzles are preferably situated at each of the opposite edges of the nozzle nose.

3 Claims, 2 Drawing Figures

POCKET VENTILATING APPARATUS FOR A MULTI-CYLINDER DRYER OF A PAPER MACHINE

BACKGROUND OF THE INVENTION

The present invention relates generally to the field of paper making and, more particularly, to the dryer section of a paper machine.

Specifically, the present invention relates to apparatus for ventilating one or more pockets in a multi-cylinder dryer of a paper machine, the multi-cylinder dryer being of the type wherein guide rolls are situated in spaces between adjoining drying cylinders and wherein a wire or felt has a run guided by the guide rolls so as to include free runs between the drying cylinders and the guide rolls. Further, the pocket ventilating apparatus comprises apparatus by means of which air is blown through the inlet or incoming free wire run into a respective pocket within the multi-cylinder dryer and wherein air is removed from the respective pocket at least partly through the following or outgoing free wire run after the guide roll.

Conventional multi-cylinder dryers in paper machines generally include two rows of drying cylinders situated one above the other and wherein a paper web runs from cylinders in one row to cylinders in another row in open draws. An upper wire or felt and a lower wire or felt is generally provided in connection with the upper and lower cylinder rows respectively, which wires or felts are guided by guide rolls situated in the spaces between adjoining drying cylinders so that the wires or felts press the web against the surfaces of the respective cylinders in the respective rows. Pockets are formed in such a multi-cylinder dryer by the open draws of the web, the free or uncovered surfaces of the drying cylinders and the wires or felts guided by the guide rolls. These pockets are usually open at their transverse ends but otherwise closed. The ventilation of these pockets is an important factor in determining the drying capacity of the multi-cylinder dryer and the uniformity of the drying effects.

In recent years, paper machine speeds have steadily increased which has resulted in the shortening of open draws of the paper web in order to reduce the risk of web breakage, especially due to fluttering. On the other hand, the shortening of the web open draws has resulted in a corresponding increase in the difficulty of ventilating the pockets of the multi-cylinder dryer since a shortening of the web free draw reduces the size of the pockets. Moreover, even higher requirements are imposed in the ventilation of the pockets since the time during which the web remains in association with any one pocket have become shorter as the paper machine speeds have been increased.

Several different arrangements for ventilating pockets in multi-cylinder dryers have been suggested wherein air is blown through the felts or wires into the respective pockets. In these arrangements, the ventilation air is removed through the transverse open ends of the pockets and/or through the free runs of the felts or wires.

With respect to the prior art pertaining to the present invention, reference is made by way of example to U.S. Pat. Nos. 3,388,479, 3,427,727, applicants' assignee's U.S. Pat. No. 3,668,787 and Finnish Pat. No. 45,584, and Finnish Pat. No. 45,363 in the name of Ab Svenska Fläktfabriken.

U.S. Pat. No. 3,388,479 discloses an arrangement wherein blowing apparatus is provided in proximity to the guide roll of the felt or wire. The blowing member directs jets of air against the free runs of the felt or wire which results in air passing through the runs of the felt or wire between adjoining drying cylinders and the guide roll for the felt or wire. Pocket ventilating apparatus which is substantially similar to that described immediately above is also disclosed in U.S. Pat. No. 3,427,727.

These prior art constructions, however, have been found in practice to have a significant drawback resulting from the fact that the nozzles of the blowing members are situated on both sides of the wire or felt guide rolls, i.e., in proximity to both the incoming and outgoing free runs of the wire or felt, so that the air blown into the pocket can escape from the pockets only through the transverse open ends thereof. This results in a considerable air flow in the transverse direction through the pockets. A transverse air flow can cause several problems, the worst being a fluttering of the edge of the web which causes a considerable increase in the risk of web breakage.

An arrangement is suggested in Finnish Pat. No. 44,331 wherein the ventilation air is introduced into the pockets through the pumping effect of the moving guide roll and wire, from one side of the guide roll into the pocket and, correspondingly, out of the pocket on the other side of the guide roll. This arrangement is not efficient and does not provide sufficiently large quantities of ventilating air since it depends only on the natural pumping effect of the various moving components. Moreover, it has been found that when used with modern wire types, the air flowing into the pocket may, depending upon the location of the wire or felt guide roll, be smaller than the outgoing air flow. This in turn results in a transverse air flow wherein air enters into the pocket from the open transverse ends thereof which in turn results in the edge portions of the paper being dried to an extent greater than the average. Still another drawback of this arrangement is the limited capacity to adjust the drying profile since the air introduced into the pocket tends to become mixed outside the wire.

Thus, the conventional arrangements discussed above are not satisfactory in the respects noted above, the problems essentially being the result of the increasing speeds of modern paper machines and the consequent reduction in the size of the pockets and the lengths of the free runs of the web.

An arrangement is disclosed in Finnish Pat. No. 45,584 wherein air is ejected by means of air which is blown through nozzle slots out of the space surrounding a blow box into a space between the blow box and the wire, from which the air flows onward through the wire. The quantity of air passing through the wire, however, remains relatively small since the positive pressure required to obtain a flow of the air through the wire is only produced within a very limited area. The air jet which is discharged from the second nozzle slot collides with a layer of air running along with the wire resulting in the ejection effect of the jet remaining quite low.

SUMMARY OF THE INVENTION

Accordingly, it is an object of the present invention to provide new and improved apparatus for ventilating one or more pockets of a multi-cylinder dryer in a paper machine.

Another object of the present invention is to provide new and improved apparatus for pocket ventilation in a multi-cylinder dryer which is more efficient than conventional arrangements.

Still another object of the present invention is to provide new and improved apparatus for ventilating one or more pockets in a multi-cylinder dryer whose operation does not result in inward flow of air into the pockets through the transverse open ends thereof and in which the profile-adjusting capacity is better than in conventional arrangements.

Still another object of the present invention is to provide new and improved apparatus for ventilating one or more pockets in a multi-cylinder dryer which is of simple construction and which can be accommodated in a relatively small space.

Yet another object of the present invention is to provide new and improved apparatus for ventilating one or more pockets of a multi-cylinder dryer having improved energy efficiency relative to conventional ventilating apparatus.

Briefly, in accordance with the present, these and other objects are attained by providing ventilating apparatus in the form of nozzle apparatus including a nozzle nose defining at least two spaced nozzles substantially facing the incoming free run of the felt or wire, each nozzle extending substantially transversely to the direction of run of the wire or felt and arranged such that air is blown through the nozzles into a space defined by the incoming free run of the wire or felt facing the nozzles, by a guide roll and by the nozzle nose. In this manner, the air directed through the nozzles generate a positive pressure in an area of the wire or felt over a length of and in the direction of run of the incoming free run of the felt or wire. As a result of the pressure, air flows within the area through the wire into the pocket.

DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
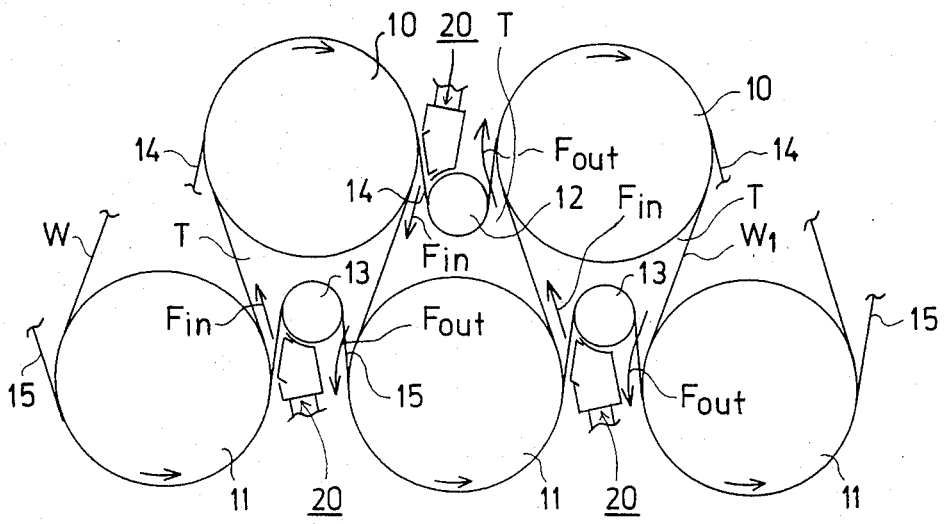
FIG. 1 is a schematic side elevation view of a part of a multi-cylinder dryer in a paper machine and illustrating apparatus for ventilating pockets thereof in accordance with the present invention.

Referring now to the drawings wherein like reference characters designate identical or corresponding parts throughout the several views, a multi-cylinder dryer of a paper machine includes a row of upper drying cylinders 10 and a row of lower drying cylinders 11 situated in intercalated relationship. A web W runs in a winding path between cylinders in one row and cylinders in another row over open draws $W_1$.

Upper and lower guide rolls 12 and 13 are situated in spaces between the drying cylinders of the corresponding rows. The upper guide rolls guide the run of an upper wire 14 and the lower guide rolls 13 guide the run of a lower wire 15, the upper and lower wires 14 and 15 covering the web W as it passes over the surfaces of the drying cylinders of the upper and lower rows.

It will be understood that although the multi-cylinder dryer described above utilizes wires 14 and 15, felts or other fabrics whose permeability to air and other characteristics are suitable can be used instead of wires. Accordingly, although the term "wires" will be used hereinbelow and in the claims, it will be understood that this term is being used in its broadest sense to include not only wires but also felts and other suitable fabrics as is well known in the art.

The construction of the multi-cylinder dryer described above is well known and are described herein only to illustrate the subject matter of the present invention which is used in combination therewith.

The free surfaces of the drying cylinders 10 and 11, i.e., the surfaces of the drying cylinders which are not contacted by the web W, together with the wires 14, 15 passing over the guide rolls 12, 13 and the unsupported runs $W_1$ of the web W define pockets T between them. The pockets T must be ventilated in order to carry off the water vapor which has evaporated from the web W. To this end and in accordance with the present invention, pocket ventilating apparatus 20 are arranged in operative relationship with the upper and lower wires 14, 15. In accordance with the illustrated preferred embodiment, pocket ventilating apparatus 20 are situated along the runs of both of the wires 14 and 15 between the respective drying cylinders 10 and 11 and the corresponding guide rolls 12 and 13.

The location of the pocket ventilating apparatus 20 with respect to the wires 14 and 15 is important. Each of the upper and lower wires has incoming and outgoing free runs with respect to respective guide rolls. Thus, the wire 14 has a free incoming run as it travels from each drying cylinder 10 to a guide roll 12 and a free outgoing run following the guide roll 12 as it travels to the next drying cylinder 10. Correspondingly, the lower wire 15 has a free incoming run prior to each guide roll 13 and a free outgoing run following each guide roll 13. According to the invention, the pocket ventilating apparatus 20 are situated in the direction of movement of the wires 14, 15 on the free incoming runs thereof while the following outgoing free runs following each guide roll remains free.

By means of the pocket ventilating apparatus 20, air is introduced through the incoming free runs of each wire 14, 15 into the corresponding pockets T in the direction of the arrows $F_{in}$ whereupon excess air escapes from the pockets at least partly from the outgoing free runs of the wires 14, 15 in the direction of the arrows $F_{out}$ and partly through the open transverse ends of the pocket T.

Figure 2:
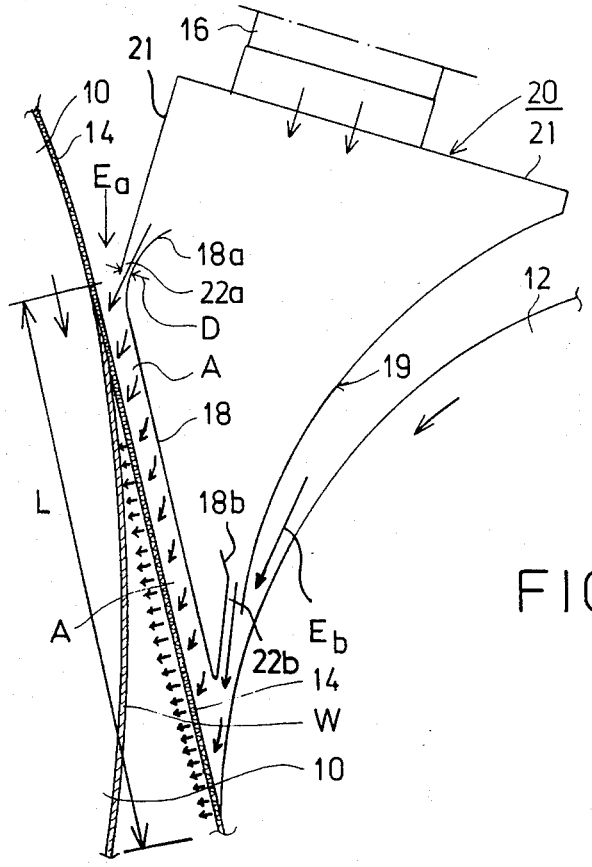
FIG. 2 is a schematic side elevation view in partial section illustrating a detailed construction of the pocket ventilating apparatus shown in FIG. 1.

Referring to FIG. 2, an example of the construction of a pocket ventilating apparatus 20 in accordance with the invention is described.

The pocket ventilating apparatus 20 includes nozzle apparatus comprising a box-shaped construction into which air is introduced by means of an inlet pipe 16. The nozzle apparatus 20 is situated in the narrowing wedge-shaped space defined by the guide roll 12 and the free incoming wire run of wire 14. The nozzle apparatus 20 is constructed of outer walls 19 and 21 which extend in a direction transverse to the direction of web travel, planar end walls (not shown) and a nozzle nose constituted by a nozzle nose member 18 which extends in the direction of the incoming free run of wire 14 in facing relationship thereto. As seen in FIG. 2, at least a portion of the nozzle apparatus 20 has a substantially wedge-shaped cross-section including a transversely extending pointed edge which is directed and which extends deeply into the narrowing wedge-shaped space defined between the incoming free run of wire 14 and guide roll 12. The edges 18*a* and 18*b* of the nozzle nose member 18 define nozzle slots 22*a* and 22*b* with the outer walls 21 and 19. These nozzle slots are spaced from each other and substantially face the incoming free run of wire 14, each nozzle extending substantially transversely to the direction of run of the wire.

According to the invention, the nozzle slots are arranged such that air discharged through the nozzles 22*a* and 22*b* is directed into a space, designated A, defined by the incoming free run of wire 14, by the guide roll 12 and by the nozzle nose member 18. Thus, in the illustrated embodiment, the nozzle slots are situated at the opposite transversely extending edges of the nozzle nose member proximate to upstream and downstream parts of the incoming free run of wire 14.

The edges 18*a* and 18*b* of the nozzle nose member 18 are formed such that the air jet discharged from the nozzle slot 22*a* is directed substantially parallel to the direction of the free incoming run of wire 14 while the air jet being discharged from the nozzle slot 22*b* is directed substantially parallel to a plane which is tangential to the guide roll 12. In this manner, a considerable positive pressure is formed within the area A by the effect of the air jets being discharged through the nozzle slots 22*a* and 22*b*. Moreover, the direction of the air jets discharged from the nozzle slots 22*a* and 22*b* together with the movement of the wire 14 and guide roll 12 results in air being drawn from the regions proximate to the edges of the area A which extend transversely to the direction of run of the incoming free wire run to create band-shaped regions at those edges which act as air seals for the space A. Thus, as shown in FIG. 2, a so-called ejection effect occurs in the direction of arrows $E_a$ and $E_b$. As a result of the increased pressure provided in the space A, air passes through the incoming free run of wire 14 into the pocket T producing a ventilation of the pocket as described above.

It is understood that similar ventilating apparatus 20 can be provided to ventilate the pockets defined by the lower guide rolls 13 in the same manner as described above in connection with the apparatus for ventilating the pockets defined by the upper guide rolls 12.

The quantity of air which passes through the wire is $V \sim k \cdot A_1 \cdot \sqrt{p}$, where $A_1$ is the cross-sectional area of flow through which air is passed through the wire 14, 15, and k is the permeability of the wire 14, 15. Under the circumstances, if a constant quantity of air is desired to be introduced through the wire 14, 15, the pressure which is required to be present in the space A can be calculated by $p \sim 1/A_1^2$.

It follows from the above that in order to introduce a maximum quantity of air through the wire 14, 15 into the respective pocket, it is necessary to provide that the positive pressure be effective over a maximum area of the wire. This requirement is advantageously satisfied by apparatus in accordance with the invention since the entire area between the nozzle nose member 18 and the incoming free run of the wire will constitute an area in which a positive pressure exists. This is not the case in prior art arrangements wherein nozzle openings or slots direct gas jets directly against the wire. In such conventional arrangements only the narrow zone adjacent to the nozzle openings or slots constitute an area at which a positive pressure exists, as a result of which the quantity of air passing through the wire has been found insufficient to provide efficient ventilation of the pocket.

The effective width D of the nozzle slots 22*a*, 22*b* is preferably in the range of between about 5 to 20 mm. The nozzle slot 22*a* is shaped so that the air flows into the space between the nozzle nose member 18 and the wire. In order to guide the air in this direction, the edge 18*a* of nozzle nose member 18 can be provided with an appropriate radius of curvature R and curve length so that the air will follow the same for an appropriate distance before separating therefrom under the so-called Coanda effect. The direction in which the air jet is discharged from the nozzle slot 22*b* is substantially parallel to the direction of a tangential plane to the guide roll 12 and it is also possible to use the Coanda effect in connection with guiding the air jet discharged from nozzle slot 22*b*.

As noted above, the nozzles 22*a* and 22*b* act as air seals and at the same time cause an ejection effect whereby air is drawn into the space A from regions proximate thereto as shown by arrows $E_a$ and $E_b$. In accordance with the invention, a positive pressure is advantageously produced within a wide area A over a distance L without any significant loss of ventilation air from the space A. In this manner, the energy consumption of the apparatus will be significantly lower than conventional ventilation apparatus with a higher efficiency.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. In apparatus for ventilating a pocket present in a multi-cylinder dryer of a paper machine, the multi-cylinder dryer including upper and lower rows of drying cylinders wherein a web runs from cylinders in one row to cylinders in another row in open draws, guide rolls situated in spaces between adjoining drying cylinders, and at least one wire having a run guided by said guide rolls to cover the web as it passes over the surfaces of the drying cylinders of a respective one of said upper and lower rows, said wire having incoming and outgoing free runs prior to and following a guide roll situated between a pair of adjoining drying cylinders of said one of said upper and lower rows, the open draws of the web together with the uncovered surfaces of the drying cylinders and free runs of said wire defining said pockets between them, said pocket ventilating apparatus including means for blowing air into a respective pocket through the incoming free wire run thereof prior to the guide roll whereupon air is removed from said pocket at least partially through the outgoing free wire run thereof following the guide roll, and wherein said ventilating apparatus for a respective pocket includes nozzle apparatus situated proximate to said run of said wire, the improvement comprising:

said nozzle apparatus includes a nozzle nose defining at least two mutually spaced nozzles substantially facing said incoming free wire run of said pocket, each nozzle extending substantially transversely to the direction of run of said wire and arranged such that air is blown therethrough into a space defined by said incoming free wire run facing said nozzles, by said guide roll and by said nozzle nose, said mutually spaced nozzles thereby constitute means for generating a positive pressure in an area of said wire over a length and in the direction of run of said incoming free run, by the effect of which pressure, air flows within said area through said wire into said pocket, said nozzle nose comprises a member extending in the direction of and facing said incoming free wire run, said nozzle nose member having opposite transversely extending edges proximate to upstream and downstream parts of said incoming free wire run respectively, and wherein said nozzles are located at both of said opposite edges of said nozzle nose member, and wherein said nozzle apparatus further include outer walls, said outer walls having portions which together with said nozzle nose member define first and second nozzle slots constituting said nozzles situated at said opposite edges of said nozzle nose member, said first nozzle slot being situated proximate to said upstream part of said incoming free wire run and constituting means for blowing air into said space in a direction substantially parallel to the direction of run of said incoming free wire run, and said second nozzle slot being situated proximate to said downstream part of said incoming free wire run and constituting means for blowing air in a direction substantially parallel to a tangent to said guide roll.

2. The combination of claim 1 wherein said guide roll and said free incoming wire run of the pocket define a narrowing wedge-shaped space and wherein said nozzle apparatus of said pocket ventilating apparatus comprises a box-shaped construction at least a part of which including said nozzle nose having a substantially wedge-shaped cross-section including a transversely extending pointed edge, said pointed edge being directed and extending deeply into said narrowing wedge-shaped space, and wherein said nozzle slots are formed at edges of said box-shaped construction, said nozzle slots extending substantially parallel to each other.

3. The combination of claim 1 wherein said nozzles defined by said nozzle nose are configured and positioned such that upon air being blown therethrough into said space to generate a positive pressure on said area of said wire at said incoming free run thereof, said nozzles further constitute means for drawing air from regions proximate to edges of said area extending transversely to the direction of run of said incoming free wire run to create band-shaped regions at said edges that act as air seals for said space.

* * * * *